United States Patent [19]

Ooka et al.

[11] Patent Number: 4,680,818

[45] Date of Patent: Jul. 21, 1987

[54] TRANSFER DEVICE FOR MOVING RECUMBENT PERSON

[75] Inventors: Akihiro Ooka, Suita; Kenji Okamoto, Kobe; Koji Yamada, Suita, all of Japan

[73] Assignees: Agency of Industrial Science and Technology; Ministry of International Trade and Industry, both of Tokyo, Japan

[21] Appl. No.: 845,337

[22] Filed: Mar. 28, 1986

[51] Int. Cl.[4] ..... A61G 7/08

[52] U.S. Cl. ..... 5/81 R; 5/81 B

[58] Field of Search ..... 5/81 R, 81 B, 81 C

[56] References Cited

U.S. PATENT DOCUMENTS

| | | | |
|---|---|---|---|
| 2,869,614 | 1/1959 | Wamsley | 5/81 R |
| 3,493,979 | 2/1970 | Koll et al. | 5/81 C |
| 3,579,672 | 5/1971 | Koll et al. | 5/81 B |
| 3,765,037 | 10/1973 | Dunkin | 5/81 C |
| 3,810,263 | 5/1974 | Taylor et al. | 5/81 R |
| 3,947,902 | 4/1975 | Conde et al. | 5/81 R |
| 3,967,328 | 7/1976 | Cox | 5/81 R |
| 4,073,016 | 2/1978 | Koll | 5/81 R |
| 4,077,073 | 3/1978 | Koll et al. | 5/81 R |
| 4,087,873 | 5/1978 | Ohkawa | 5/81 B |
| 4,125,907 | 11/1978 | Junginger et al. | 5/81 B |

*Primary Examiner*—Thomas J. Holko

*Assistant Examiner*—Carl M. DeFranco, Jr.

*Attorney, Agent, or Firm*—Oblon, Fisher, Spivak, McClelland & Maier

[57] ABSTRACT

A device for moving a recumbent person comprises a baseplate, an insertion plate formed integrally of two flat plates stacked vertically with a small gap therebetween and attached to the baseplate to be horizontally extensible and retractable with respect thereto, a pair of rollers disposed one above the other at the proximal end of the baseplate, a first belt fixed to the upper of said pair of rollers at one end so as to be windable thereon, passed outward across the upper surface, around the distal edge and back along the lower surface of the upper flat plate of the insertion plate, and fixed to the lower of said pair of rollers at the other end so as to be windable thereon, and a second belt encircling the lower flat plate of the insertion plate and having its opposite ends fixed to the baseplate near the distal end thereof. When a recumbent person is to be moved, the insertion plate is inserted under the person while the first belt is simultaneously fed out from the lower roller so that the during the insertion of the insertion plate the first belt remains stationary. The upper and lower rollers are then rotated to draw in the belt together with the insertion plate, thus transferring the recumbent person onto the device proper.

4 Claims, 9 Drawing Figures

TRANSFER DEVICE FOR MOVING RECUMBENT PERSON

FIELD OF THE INVENTION AND RELATED ART STATEMENT

This invention relates to a device for moving a recumbent person and more particularly to a device for picking up and moving a person lying, for example, on a bed.

Many sick and disabled persons are unable to get up by themselves and require the assistance of an attendant everytime they eat or bathe. For moving such a person it is ordinarily necessary for the attendant to pick the person up in his arms, although there are also available on the market suspension devices for lowering a recumbent person and for transferring such a person to a wheelchair-like table.

When the person to be moved is an adult, the method of moving him by picking him up directly in the arms is very hard work and has to be done while standing in a posture that is unnatural for lifting so that an attendant who frequently has to move recumbent persons is likely to suffer from back pains. This has been a very serious problem at hospitals and other facilities where bedridden persons are cared for.

On the other hand, when a device for suspending the person or for transferring him to a wheelchair is used, it is necessary to provide a mat-like sheet under the person to be moved in advance or to raise the person at the time of moving him in order to insert a mat-like sheet between the person and the bed. Thus, these devices do not greatly reduce the attendant's work.

OBJECT AND SUMMARY OF THE INVENTION

An object of the invention is to provide a device for moving a recumbent person which enables the person to be easily moved while remaining recumbent.

For attaining this object, the invention provides a device for moving a recumbent person comprising a baseplate, an insertion plate formed integrally of two flat plates stacked vertically with a small gap therebetween and attached to the baseplate to be horizontally extensible and retractable with respect thereto, a pair of rollers disposed one above the other at the proximal end of the baseplate, a first belt fixed to the upper of said pair of rollers at one end so as to be windable thereon, passed outward across the upper surface, around the distal edge and back along the lower surface of the upper flat plate of the insertion plate, and fixed to the lower of said pair of rollers at the other end so as to be windable thereon, a second belt encircling the lower flat plate of the insertion plate and having its opposite ends fixed to the baseplate near the distal end thereof, drive means for separately rotating the upper and lower rollers in either the forward or reverse direction, and drive means for extending-and retracting the insertion plate. When the insertion plate is extended for insertion under the recumbent person, the first belt is unwound from the lower roller so that the portion of the upper belt on the upper surface of the upper flat plate stays stationary as it moves under the recumbent person and when the insertion plate is retracted said portion of the belt retracts together therewith.

When the device of the aforesaid structure according to this invention is used to move a person lying on a bed, the insertion of the insertion plate between the person and the bed is enabled by suppressing the rotation of the upper roller and permitting the rotation of the lower roller so that the first belt is unwound from the lower roller as the insertion proceeds. As a result the portion of the first belt on the top surface of the upper flat plate does not move so that no kinetic friction arises between the recumbent person and the first belt. Moreover, as the upper surface of the second belt is in contact with the lower surface of the first belt so that the second belt is carried along with the first belt without any kinetic friction arising between the two belts. As a result, the insertion plate passes under the recumbent person very smoothly.

Once the recumbent person has been placed on the insertion plate by the aforesaid operation, both the upper and lower rollers are driven to draw in the first belt by winding it thereon while the insertion plate is simultaneously retracted. As a result, the recumbent person can be easily picked up and removed from the bed.

The other objects and features of the invention will be clear from the following explanation made with reference to the drawings.

DESCRIPTION OF THE PREFERRED EMBODIMENTS

Figure 1:
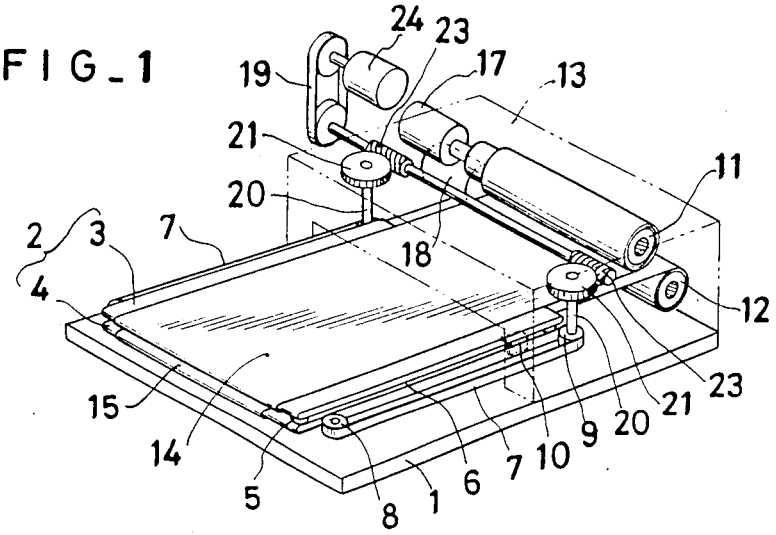
FIG. 1 is a perspective view of an embodiment of the device for moving a recumbent person according to this invention.
Figure 2:
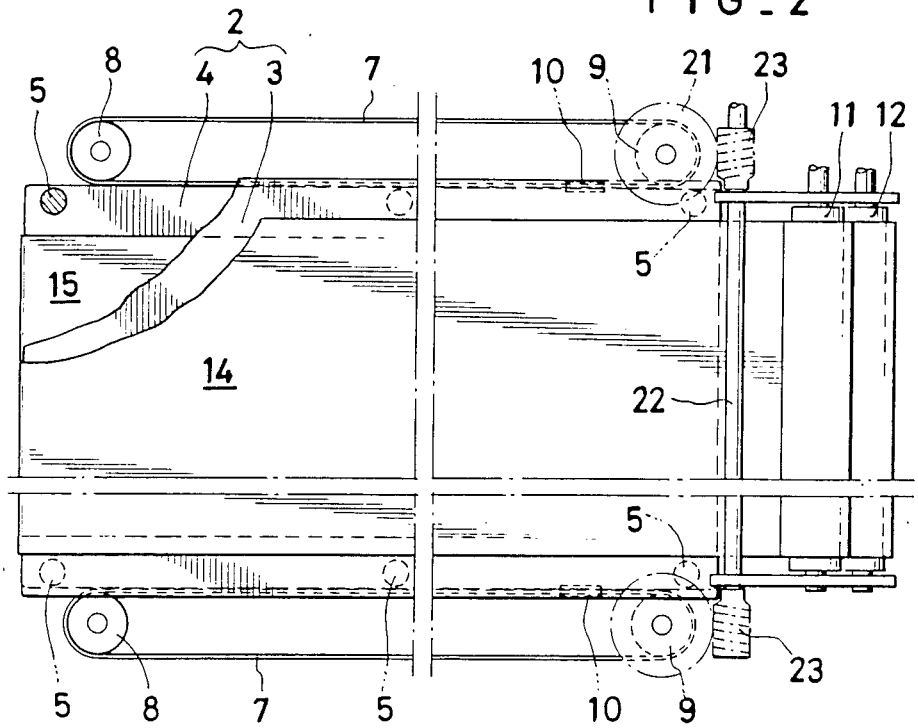
FIG. 2 is a schematical plan view of the device in FIG. 1.
Figure 3:
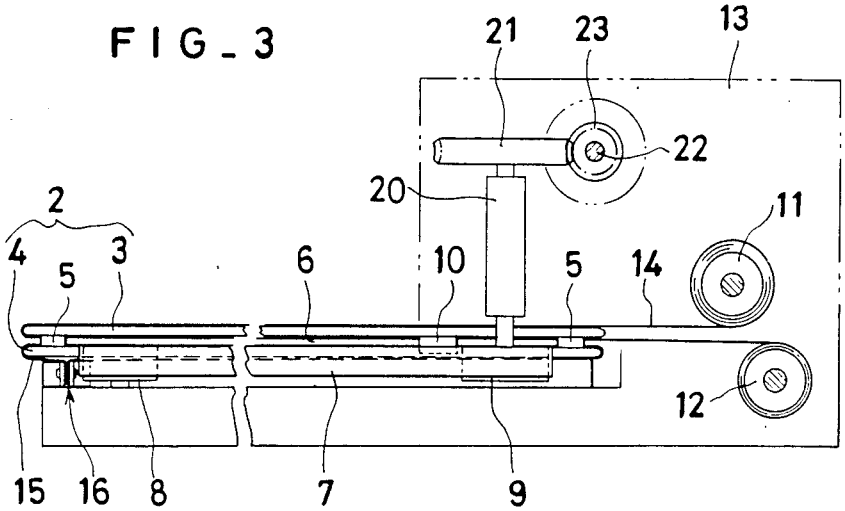
FIG. 3 is a schematical side view of the device in FIG. 1.

A first embodiment of the device for moving a recumbent person according to this invention is illustrated in FIGS. 1–3. The device has a horizontal baseplate 1. On the baseplate 1 is provided an insertion plate 2 consisting of an upper flat plate 3 and a lower flat plate 4 disposed one over the other and connected to each other at the distal and proximal edges by two pairs of spacers 5 so as to maintain a small gap 6 between the two flat plates. The insertion plate 2 can be horizontally extended and retracted. At the rear (proximal) portion of the baseplate 1, an upper roller 11 and a lower roller 12 are rotatably supported by a supporting frame (not shown). A first belt 14 is fixed at one end to the upper roller 11, passed outward across the top surface of the upper flat plate 3, around the distal edge thereof, back along the bottom surface thereof, and fixed at its other end to the lower roller 12. On the other hand, the lower flat plate 4 is encircled by a second belt 15 which has its opposite ends fixed to the baseplate 1 near the distal edge thereof by means of a fixing member 16. The upper and lower rollers 11 and 12 are respectively connected with drive means 17 and 18 capable of separately driving them in either the forward or reverse directions. The drive means 17 and 18 may, for example, be constituted of motors, speed-reduction mechanisms and braking devices.

A pair of endless belts 7 are trained along either side of the insertion plate 2 and wound about pulleys 8 and 9. One part of the endless belt 7 is connected to the rear surface of the upper flat plate 3 of the insertion plate 2 by a connector 10. Each of the pulleys 9 has a shaft 20 provided at its upper end with a worm wheel 21 in engagement with a worm gear 23 provided on a transmission shaft 22 and driven by a motor 24 via a transmission belt 19. (The supporting frame for the shafts 20 and 22 is not shown in the drawings.) The worm wheel 21 and the worm gear 23 on one side are threaded oppositely from the corresponding members on the other side so that the two worm wheels are driven in opposite directions by the motor 24. As a result, the two endless belts 7 act to drive the insertion plate 2 over the baseplate 1 in the same direction, namely to extend or retract it depending on the direction of rotation of the motor 24. The aforesaid drive mechanisms are covered with a cover 13.

The operation of the device of the foregoing structure will now be described with respect to FIG. 4 wherein the device is denoted by reference numeral 32. The device 32 is placed on a wheeled table or the like (not shown) and brought to the side of the bed 31 on which the person 30 to be moved lies (FIG. 4(*a*)). At this time, all of the excess length of the first belt 14 is wound on the lower roller 12 and the upper roller 11 is prevented from rotating by a braking means.

Next, a signal is sent to the motor 24 in order to operate the drive means for the insertion plate and cause the insertion plate 2 to extend. At this time, the lower roller 12 is allowed to rotate freely under a slight braking force. Thus, as the extension of the insertion plate 2 proceeds, the first belt 14 advances around the distal edge of the upper flat plate 3 in the direction shown by the arrow, i.e. from the bottom to the top surface of the upper flat plate 3. Therefore, as the insertion plate advances between the person 30 and the bed 31, a force operates in the direction of moving the person onto the upper flat plate 3 (FIG. 4(*b*)). On the other hand, the second belt 15 advances around the distal end of the lower flat plate 4 from the upper surface to the lower surface thereof, as indicated by the arrow. As a result, the lower flat plate 4 is able to advance smoothly over the surface of the bed 31.

As the lower roller 12 is subjected to a certain degree of braking force as the first belt 14 is unwound therefrom during advance of the insertion plate 2 between the person 30 and the bed 31, an appropriate degree of tension is maintained in the first belt 14 so that the portion thereof on the top surface of the upper flat plate 3 does not become slack.

Moreover, since the portion of the first belt 14 on the top surface of the upper flat plate 3 remains stationary, no kinetic friction arises between the first belt 14 and the person 30. Since no kinetic friction arises either between the portion of the second belt 15 on the bottom surface of the lower flat plate 15 and the surface of the bed 31, the insertion plate 2 passes smoothly under the person 30.

Though no kinetic friction arises between the first belt 14 and the person 30 or between the second belt 15 and the bed 31, kinetic friction does arise between the first and second belts 14, 15 and the associated upper and lower flat plates 3, 4. Therefore, in order to minimize the force required for insertion of the insertion plate 2 it is advisable to reduce the coefficient of friction between the inside surfaces of the belts 14, 15 and the surfaces of the upper and lower flat plates 3, 4 as much as possible.

Once the extension of the insertion plate 2 has progressed to the point that the recumbent person is loaded completely onto the upper flat plate 3 as shown in FIG. 4(*c*), the rollers are rotated reversely as indicated by the arrows in the same figure, so as to wind in the first belt 14 from both ends, and at the same time the insertion plate 2 is retracted by reverse operation of the drive means. During the extension and retraction operations, it is not necessary to control the rate of rotation of the rollers 11, 12 to match it with the rate of retraction of the insertion plate 2, but only necessary to assure that the rollers 11, 12 rotate rapidly enough to wind in the first belt 14 at a higher speed than the speed of retraction of the insertion plate 2 to keep the first belt 14 in the strained state.

More specifically, feed-out of the first belt 14 during extension can be accomplished using the pulling force exerted thereon by the insertion plate 2 as it advances, while during retraction it is sufficient to wind in the first belt 14 by rotating the rollers 11, 12 using a somewhat strong force.

It is preferable to make the upper and lower flat plates 3, 4 as thin as practical since the thinner they are, the lower is the force required for insertion between the person 30 and the bed 31 and the more comfortable is the sensation perceived by the person 30. While in the drawings, the flat plates 3, 4 appear to be relatively thick, this is only for the sake of clarity in illustrating the device and in fact each plate has a thickness of only about 1 cm.

As was described earlier, the insertion plate 2 bearing the person 30 is retracted, thereby transferring the person 30 onto the baseplate 1 of the device 32 as shown in FIG. 4(*d*). At this time, about the same length of the first belt 14 is wound onto each of the rollers 11, 12. After the person 30 has been transferred to the device 32 in this way, the device 32 bearing the person 30 is transferred to the destination of the person 30 by a wheeled table or the like. When the person 30 is to be transferred to a different bed at his destination, it is sufficient to operate the device 32 in exactly the opposite manner from that described above.

Figure 5:
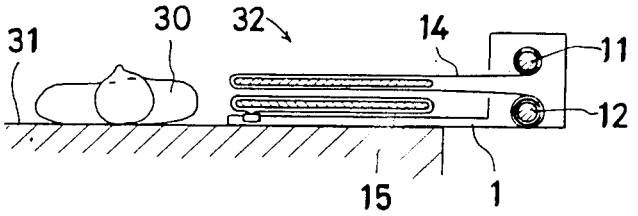
FIG. 5 is an explanatory view showing another mode of use of the device according to this invention.

Although FIG. 4 illustrates a case where the recumbent person is loaded onto the device 32 from a position near the outside edge of his bed, the person to be moved may of course be lying at a different part of the bed. Thus, since the range to which the insertion plate 2 can be extended is limited, there will be cases where it will be difficult or impossible to transfer the person from the bed to the device. To overcome this problem, it is possible, as shown in FIG. 5, to make the baseplate 1 as thin as practical and to use a structure which allows the entire device 32 to be placed on the bed.

Figure 6:
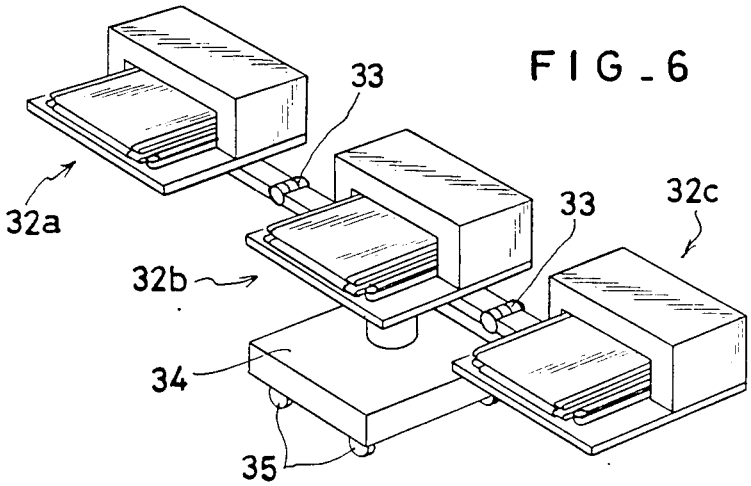
FIG. 6 is a perspective view of another embodiment of the device for moving a recumbent person according to this invention.
Figure 4A:
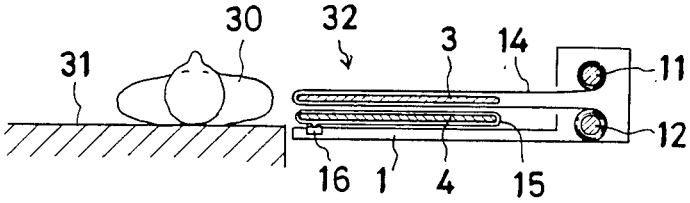
FIG. 4 is a series of explanatory views for demonstrating the mode of operation of the device according to this invention, wherein FIG. 4(*a*) shows the device positioned at the side of a recumbent person, FIG. 4(*b*) shows the insertion plate of the device being inserted beneath the recumbent person, FIG. 4(*c*) shows the recumbent person fully transferred to and lying on the insertion plate, and FIG. 4(*d*) shows the recumbent person carried by the device.
Figure 4B:
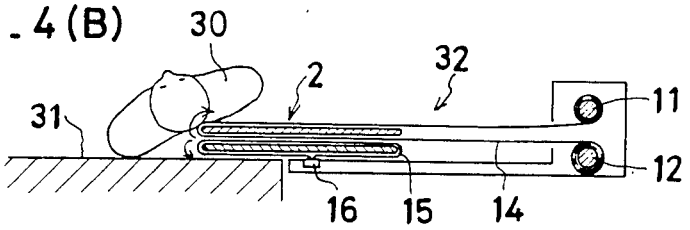
Figure 4C:
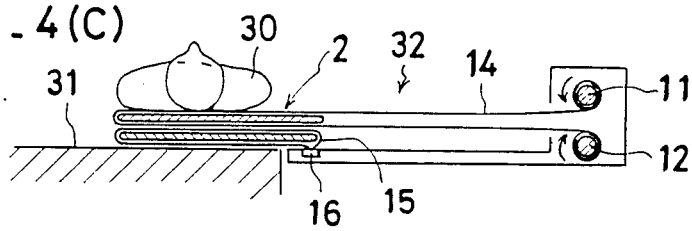
Figure 4D:
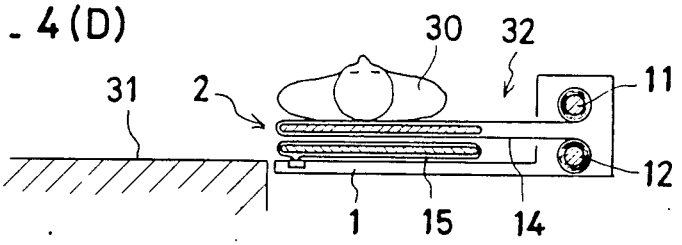

The length of the device 32 is best made about the same as the length (i.e. standing height) of the person 30. However, if for space-saving reasons, it is desired to make the device 32 more compact, this can be realized by constructing the device 32 as a plurality of units (generally three) each measuring about 50 cm in length. Such an arrangement is illustrated in FIG. 6 which shows three such units 32*a*, 32*b*, 32*c* interconnected by hinged arms 33 so that the outside units 32*a*, 32*c* can be folded inwardly when the device is not in use. As the center unit 32*b* is provided on a dolly 34 having wheels 35, the device can be easily moved to the place where it is to be used. When a person 30 is to be loaded onto the device, outside units 32*a*, 32*c* are rotated outwardly about the hinges to the extended position shown in FIG. 6. After the person has been loaded onto the device, the outside units 32*a*, 32*c* can, if desired, be rotated upwardly/downwardly about the hinges so as to form the device into the shape of a wheel chair, making it possible for the person being moved to assume a sitting posture. When the device is to be stored, the amount of space it takes up can be reduced by swinging the outside units 32*a*, 32*c* upwardly to bring them together above the center unit 32*b* or downwardly so that they are suspended at the side of the center unit 32*b*.

As the device for moving a recumbent person according to this invention makes it possible to load a recumbent person onto the insertion plate simply by inserting the insertion plate under the person as he lies on a bed and then to transfer him onto the baseplate, and also makes it possible to carry out the reverse operation, it greatly reduces the amount of labor of the attendant and also makes the move much easier for the person being moved in comparison with the case where an attendant picks him up in his arms.

The device according to this invention is also structurally advantageous since the top and bottom surfaces of the insertion plate are provided with belts which remain stationary with respect to the person and the bed during the extension (insertion) and retraction of the insertion plate, thereby preventing kinetic friction from arising between the belts and the person or bed. The amount of force required for insertion of the insertion plate is thus intrinsically small and can be reduced even further by using materials for the belts and upper and lower flat plates which minimize the coefficient of friction therebetween.

For feed-out of the first belt during insertion of the insertion plate, it is only necessary to arrange for the belt to be drawn out by the force of the extending insertion plate while maintaining a certain amount of tension therein.

Moreover, once the person has been loaded on the insertion plate and is to be transferred to the device proper, the winding in of the first belt can be accomplished simply by applying a somewhat large rotating force to the rollers and the structure of the mechanism can thus be made simple since there is no need for synchronizing the operations of the insertion plate and the rollers.

The device is further advantageous in that the person being moved need not be lying at the outside edge of the bed but may be lying at the center or any other part thereof.

What is claimed is:

1. A device for moving a recumbent person, comprising:

a baseplate;

a pair of rollers disposed at the proximal end of said base plate, each roller of said pair of rollers having independent drive means for rotating said roller in both forward and reverse directions;

an insertion plate consisting of two flat plates mutually fixed one above the other with a small gap therebetween and supported on said baseplate;

an upper belt having an upper end fixed to one of said pair of rollers and a lower end fixed to the other of said pair of rollers, said upper belt passing vertically over a front edge of the upper thin flat plate of said insertion plate and extending rearwardly from said front edge to said upper and lower ends thereof;

a lower belt having opposite ends secured to a front portion of said base plate at a lower surface of said lower plate, said lower belt passing over a top surface of said lower plate;

a pair of endless belts disposed on the opposite sides of said insertion plate;

a pair of coupling members for coupling said endless belts and said insertion plate;

pulleys supporting said endless belts; and drive means independent of said roller drive means for driving said endless belts, whereby said insertion plate is driven in horizontal directions with respect to said base plate by said endless belts.

2. A device for moving a recumbent person according to claim 1, wherein one belt of said pair of endless belts is disposed at each end of said insertion plate, wherein each coupling member of said pair of coupling members couples one of said endless belts to an associated end of said insertion plate, wherein said pulleys comprise a pair of pulleys for supporting each of said endless belts, and wherein said drive means comprise means for driving said endless belts, said pulleys being supported to rotate about axes lying perpendicular to said base plate and said means for driving said endless belts being disposed rearwardly of said pulleys.

3. A device for moving a recumbent person, comprising three units, each said unit comprising a base plate, a pair of rollers disposed at the proximal end of said base plate, and independent drive means for rotating each roller of said pair of rollers in forward and reverse directions, an insertion plate consisting of two thin flat plates mutually fixed one above the other with a small gap therebetween and supported on said base plate, an upper belt having an upper end fixed to one of said pair of rollers and a lower end fixed to the other of said pair of rollers, said upper belt passing vertically over a front edge of said upper thin flat plate and extending from said front edge to said upper and lower ends thereof, a lower belt having opposite ends secured to a front portion of said base plate at a lower surface of said lower plate, said lower belt passing over a top surface of said lower plate, a pair of endless belts disposed on the opposite sides of said insertion plate, a pair of coupling members for coupling said endless belts and said insertion plate, a pair of pulleys supporting said endless belts, and drive means independent of said roller drive means for driving said endless belts, whereby said insertion plate is driven in horizontal directions with respect to said base plate by said endless belts, and wherein said three units are mutually disposed to be respectively positionable opposite the head, trunk and legs of a person to be moved and are foldably connected with one another by hinged arm members.

4. A device for moving a recumbent person according to claim 3 wherein the unit positionable opposite the trunk of the person to be moved includes a dolly for supporting said device.

* * * * *